US010527396B2

(12) United States Patent
Raymond

(10) Patent No.: US 10,527,396 B2
(45) Date of Patent: Jan. 7, 2020

(54) DEVICE FOR DESTROYING DANGEROUS OBJECTS BY DETONATING THEM AND METHOD FOR PRODUCING SUCH A DEVICE

(71) Applicant: AIRBUS SAFRAN LAUNCHERS SAS, Issy-les-Moulineaux (FR)

(72) Inventor: Gérald Raymond, Saint Medard en Jalles (FR)

(73) Assignee: ARIANEGROUP SAS, Paris (FR)

( * ) Notice: Subject to any disclaimer, the term of this patent is extended or adjusted under 35 U.S.C. 154(b) by 122 days.

(21) Appl. No.: 15/508,650

(22) PCT Filed: Sep. 1, 2015

(86) PCT No.: PCT/EP2015/069970
§ 371 (c)(1),
(2) Date: Mar. 3, 2017

(87) PCT Pub. No.: WO2016/034595
PCT Pub. Date: Mar. 10, 2016

(65) Prior Publication Data

US 2017/0284781 A1 Oct. 5, 2017

(30) Foreign Application Priority Data

Sep. 4, 2014 (FR) ..... 14 58270

(51) Int. Cl.
*F42D 5/04* (2006.01)

(52) U.S. Cl.
CPC ..... *F42D 5/04* (2013.01)

(58) Field of Classification Search
CPC ..... F41A 3/66; F42D 5/04; F42D 5/05; F42B 33/06; F42B 33/067; F42B 39/14;
(Continued)

(56) References Cited

U.S. PATENT DOCUMENTS 3,491,847 A * 1/1970 Abbott ..... B65D 85/68 180/271
3,801,416 A * 4/1974 Gulbierz ..... F42D 5/05 109/49.5

(Continued)

FOREIGN PATENT DOCUMENTS

CN 1356917 7/2002
CN 2183550 9/2005

(Continued)

OTHER PUBLICATIONS

International Search Report, International Application No. PCT/EP2015/069970, dated Oct. 5, 2015.

(Continued)

*Primary Examiner* — Joshua E Freeman
*Assistant Examiner* — Bridget A Cochran
(74) *Attorney, Agent, or Firm* — Gottlieb, Rackman & Reisman, PC

(57) ABSTRACT

A device for destroying dangerous objects such as shells, munitions or other charges that are to be destroyed by detonating them, which device includes a packaging produced from a flat blank folded on itself along three folds, four folds or more in order to form at least three sides and two half, four sides or four sides and a flap for closing the packaging which is produced in the form of a tubular package of polygonal and notably square or rectangular cross section once the flat blank has been folded up, with explosive charges placed on the sides that are to be folded, the flat blank being of dimensions suited to being able to house, in the middle of the tubular package in contact with the explosive charges, one or more of the dangerous objects that are to be destroyed.

16 Claims, 6 Drawing Sheets

(58) Field of Classification Search
CPC .... F42B 12/46; F42B 1/02; F42B 3/00; F42B 3/08; F42B 5/00; F42B 8/04
USPC ..... 86/50; 89/1.13; 102/403
See application file for complete search history.

(56) References Cited

U.S. PATENT DOCUMENTS 5,044,252 A * 9/1991 Gamadi ..... F41H 5/06 109/78
5,524,524 A * 6/1996 Richards ..... F21S 2/00 102/310
5,959,233 A * 9/1999 Garcia ..... F41H 11/14 102/403
6,289,816 B1 * 9/2001 Keenan ..... F42B 39/16 102/303
7,980,166 B1 * 7/2011 Fuqua ..... F41H 5/08 86/50
8,037,797 B1 * 10/2011 Frank ..... F41H 11/14 89/1.13
8,573,125 B1 * 11/2013 Rossow ..... F42D 5/05 102/303
2005/0223881 A1 * 10/2005 Cirillo ..... F42B 39/14 86/50
2007/0119851 A1 * 5/2007 James ..... F42B 39/14 220/88.1
2012/0137860 A1 * 6/2012 Koide ..... F42D 5/04 86/50
2013/0000469 A1 * 1/2013 Murray ..... F42B 33/0228 86/50
2013/0160635 A1 6/2013 Ueda et al.
2017/0219329 A1 * 8/2017 Ohlson ..... F42D 5/045
2018/0112963 A1 * 4/2018 Nzengung ..... F42D 5/05

FOREIGN PATENT DOCUMENTS

DE 202012006542 9/2012
EP 2416109 2/2012
FR 2931229 11/2009
JP 2006029608 2/2006
WO 2005085746 9/2005

OTHER PUBLICATIONS

Chinese Patent Office, Search Report for corresponding patent application No. 2015800578461, dated Mar. 26, 2018.
European Patent Office, Written Opinion for PCT/EP2015/069970, dated Oct. 5, 2015.

* cited by examiner

DEVICE FOR DESTROYING DANGEROUS OBJECTS BY DETONATING THEM AND METHOD FOR PRODUCING SUCH A DEVICE

CROSS-REFERENCE TO RELATED APPLICATIONS

This application is the National Stage of International Application No. PCT/EP2015/069970, having an International Filing Date of 1 Sep. 2015, which designates the United States of America, and which International Application was published under PCT Article 21(2) as WO Publication No. 2016/034595 A1, and which claims priority from and the benefit of French Application No. 1458270, filed 4 Sep. 2014, the disclosures of which are incorporated herein by reference in their entireties.

BACKGROUND

1. Field

The presently disclosed embodiment pertains to the destroying of dangerous objects such as shells or other munitions. In particular, the disclosed embodiment concerns the field of demilitarization and more generally all sectors of environmental protection. It pertains in particular to a secure device for preparing the destruction by confined explosion of dangerous objects, as well as to the method for realization and implementation of such a device.

2. Brief Description of Related Developments

Each year, 30 to 50 tons of chemical munitions are found in the former battlegrounds of France, especially in the east and the north of France.

Around 60,000,000 toxic shells have been fired on the battlegrounds of the northeast of France. Ten to fifteen percent of them did not go off, or nearly 100,000 tons. Even though many of these munitions have already been found since the end of the European conflicts, the pace of the finds should remain constant for the coming centuries. This is also the case for regions of the world where such weapons have been utilized or stockpiled. The destruction and the neutralization of such objects poses formidable technical problems.

The destruction of chemical products needs to be done in a closed environment in order to avoid the dissemination of toxic molecules and their degradation products, often themselves highly dangerous (arsenic, for example). The simultaneous presence of the explosive charge and the toxic products makes the neutralization operations difficult and dangerous. The difficulty is at its highest when the munitions in question are in a state which does not allow for their disassembly, either because of their corrosion or because their firing system is already aligned, that is, armed and triggered.

Several techniques of neutralization have been implemented over the course of time: remote controlled piercing or sawing, acid dissolving, auto detonation in an armored furnace.

One of the most effective and most versatile methods consists in surrounding the munition with massive explosive charges and causing the whole to explode in an armored detonation chamber. The heat and the shock wave fracture the munition and destroy its explosive and/or toxic contents.

The major drawback of the method is the large number of manual operations needed: preparation of the munition and additional charges, putting in place the ignition line, loading of the chamber; these operations most often needing to be done in protective clothing.

SUMMARY

In view of this prior art, the disclosed embodiment proposes simple and economical means of enabling a remote operation of the above-described method and thus ensuring the safety of the workers. Furthermore, the disclosed embodiment enables a faster pace of destruction of the charges.

More precisely, the disclosed embodiment proposes a device for destroying dangerous objects such as shells, munitions, or other charges that are to be destroyed by detonating them, comprising a packaging produced from a flat blank folded on itself along at least three folds, four folds, or more folds in order to form at least three sides and two half-sides, four sides or four sides and a flap for closing the packaging which is produced in the form of a tubular package of polygonal and notably square or rectangular cross section once the flat blank has been folded up, with explosive charges placed on the sides that are to be folded, said flat blank being of dimensions suited to being able to house, in the middle of the tubular package in contact with the explosive charges, one or more of said dangerous objects that are to be destroyed.

According to a first aspect of the disclosed embodiment, support plates secured to the sides are intercalated between the explosive charges and said sides, the support plates having a width such that they leave portions of sides free to enable the folding of the flat blank.

The support plates are advantageously plates of flexible polymer foam.

The support plates are preferably of a thickness adapted to the diameter of the explosive charges and that of the charge or charges to be destroyed so as to maintain said charges in contact.

The flat blank is advantageously a flat cardboard blank provided with folding lines to reduce the cost of the package.

According to a second aspect of the disclosed embodiment, the flat blank is a flat foam blank made of polymer foam provided with pre-cut folds.

The polymer foam is advantageously a polyurethane foam.

The device advantageously comprises means of fixation of the explosive charges to the sides.

The device advantageously comprises holding straps.

According to a particularly advantageous aspect of the disclosed embodiment, the device comprises an ignition line for the explosive charges.

The disclosed embodiment furthermore concerns a method of producing a package for destroying dangerous objects such as shells, munitions, or other objects that are to be destroyed by detonating them, which involves:

a. laying flat a flat blank intended to be folded on itself along at least three folds or four folds in order to form respectively four sides, three sides and two half-sides, or four sides and a flap for giving the packaging the form of a tubular package of square or rectangular cross section once the flat blank has been folded up;

b. placing explosive charges on the sides to be folded in an arrangement adapted to surround a charge which is to be destroyed once the flat blank has been folded up;

c. placing the charge which is to be destroyed on the charges of one side around which the other sides will be folded up;

d. placing an ignition line in contact with at least one of the explosive charges;

e. folding up the flat blank so that the charge to be destroyed is surrounded by the explosive charges and situated in the area of the central axis of the tubular package.

According to a first aspect of the method, flexible foam plates are positioned on the sides of the flat blank folded up prior to the placement of the explosive charges, the explosive charges being themselves placed on the plates.

According to an alternative aspect of the method, the flat blank is made of foam and it is previously provided with pre-cut folds and slits to receive stowage straps.

The explosive charges are preferably secured to the sides or the plates by the stowage straps.

The method advantageously involves a step of outfitting the package with holding straps, a step of attaching the package to a cargo handling apparatus by means of the holding straps, the attaching of the package by the holding straps in a detonation chamber, and then the detonation of the package by means of the ignition line.

BRIEF DESCRIPTION OF THE DRAWINGS

Other characteristics and advantages of the aspects of the disclosed embodiment will be apparent from a perusal of the following description of a nonlimiting sample aspect of the disclosed embodiment making reference to the drawings, which show.

DETAILED DESCRIPTION

In order to reduce if not eliminate manual operations of handling of munitions or charges which are to foe destroyed, the presently disclosed embodiment proposes the design of a pre-outfitted packaging means comprising explosive charges and an ignition line. The charge or charges to be destroyed can then be placed on this means which, by a simple remote-controlled operation, will form a package to be introduced inside a detonation chamber to make it explode.

One advantage of the disclosed embodiment is that the explosive charges and the ignition line are new pyrotechnical products, so that they can be handled directly by a worker in keeping with the safety standards and in particular obeying the maximum quantities of explosive present.

The pre-outfitted packaging means of the disclosed embodiment performs in particular the following functions:

it allows the pre-positioning of the explosive charges and ignition line;

it places the explosive charges against the munition in order to fracture it;

it has an easily remote-controlled holding interface for the final packaged;

it is compatible with industrial constraints: low cost, easy stockpiling and procurement.

Figure 1:
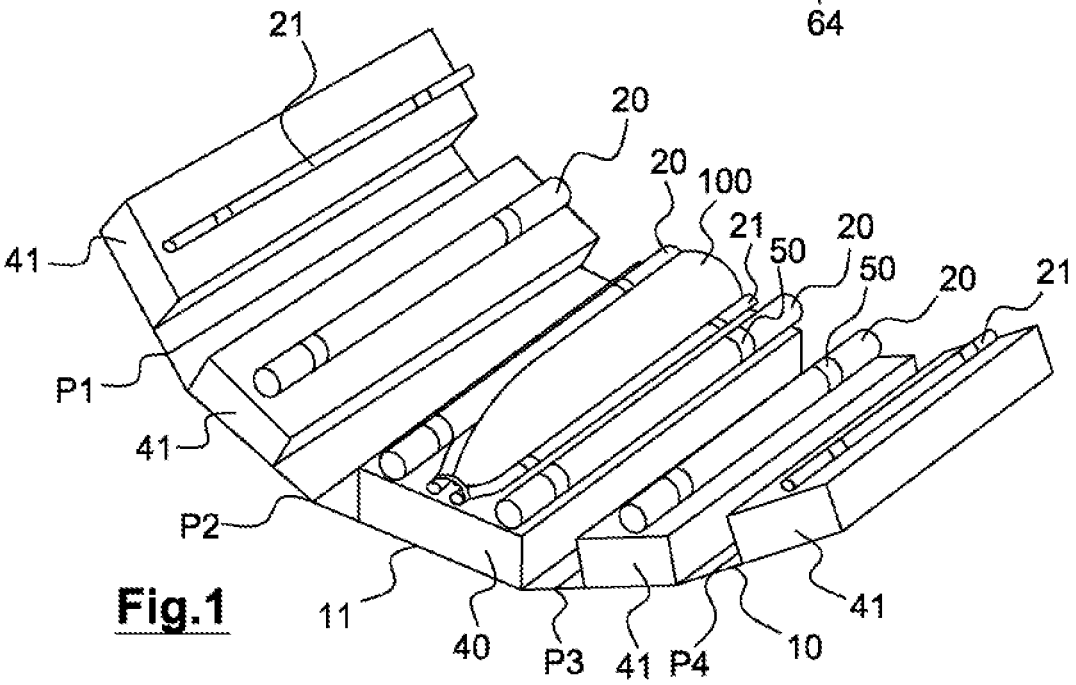
FIG. 1 is a perspective view of a device produced according to the disclosed embodiment after placement of explosive charges and a charge which is to be destroyed.

FIG. 1 shows a sample aspect of a device according to the disclosed embodiment prior to folding. Blocks of foam 40, 41 are glued to a flat blank 10, for example a thick standard cardboard packaging plate.

The flat blank can be in particular a strong packaging cardboard with thickness of 10 mm and triple fluting whose principal fiber (axis of the flutings) is positioned perpendicular to the axis of the munitions in order to prevent a flexing of the package once folded. To enable its folding the flat blank may comprise embossed folding lines.

The foam plates 40, 41 are, for example, plates of polymer foam such as a standard polyurethane foam of type 48 kg/m3 for the plate supporting the munition, 24 kg/m3 for the other sides of the folded packaging. The foam plates are simply glued (by adhesive tapes or a spray glue, for example) to the cardboard of the packaging.

The flat blank can be placed on a support board such as a polacrylate plate of thickness 16 mm and width 60 mm.

Explosive cakes forming the explosive charges 20, 21 are secured to the support plates such as blocks of foam with the help of means of fixation of the explosive charges such as small straps 50 provided preferably with Velcro means but also being possibly elastic. Typically, the explosive charges are explosive charges used in mining and road building, such as emulsion type.

The flat blank comprises folding lines p1, p2, p3, p4 defining sides 11, 12, 13, 14*a*, 14*b* and the charge to be destroyed, here a shell 100, which is placed on the explosive charges disposed on the principal side 11 of the device about which the flat blank will be folded.

Figure 2:
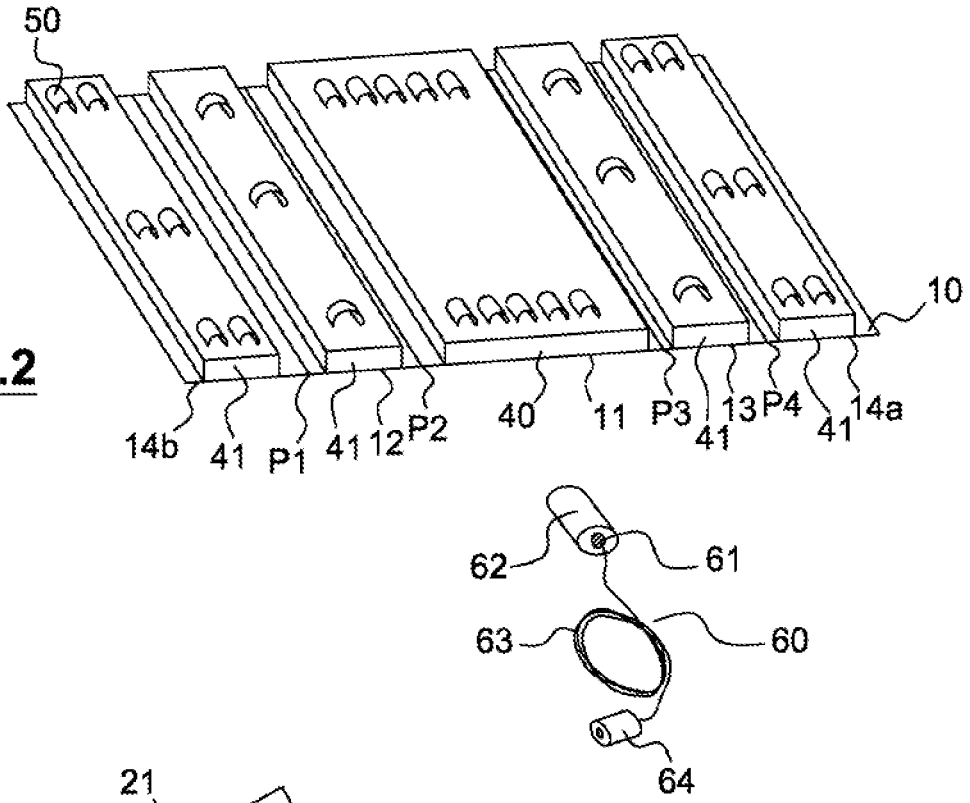
FIG. 2 is a perspective view of the device of FIG. 1 before the placement of explosive charges.

FIG. 2 shows the flat blank outfitted with support plates 40, 41 without the explosive charges. The principal side 11 and its support plate 40 is broader than the lateral sides 12, 13 and the outermost sides 14*b*, 14*c* adapted to produce the top surface of the packaging. These lateral and outermost sides receive plates of lesser width 41. The plates 40, 41 received by the sides are sliced to have a reduced width in relation to the sides in order to allow the folding of the packaging in the form of a tubular box.

The means 50 of fixation of the explosive charges of strap type, such as two parts provided with Velcro or elastic material, are mounted on the flat blank and pass through slits in the support plates.

The device furthermore comprises an ignition line 60 which is a standard device composed of an electric detonator 61 or initiator and a detonating charge 62 or booster. This ignition line has the duty of simultaneously igniting all the additional charges 20, 21. The initiator and the detonating charge are placed at one end of the box, where the action of compression of the foam blocks will press the explosive cakes against them. An electric wire 63 connecting the detonator to a control module 64 is folded on one of the flanks of the box and held in place by fasteners, such as Velcro straps. The control module 64 connected to the initiator by the wire 63 can thus be moved away from the box.

The putting in place of explosive charges such as explosive cakes as well as the putting in place of the ignition line can be done in a manual manner in ad hoc premises on the plate outfitted with support plates and explosive charges. Once the plate has been prepared in this way, it is taken to premises reserved for the operations involving the handling of the charges which are to be destroyed. There, the dangerous nature of the operations requires a remote handling.

The foam plates 40, 41 and explosive charges 20, 21 are arranged such that they form a cavity enabling a stable and remote-controlled placement of the charge to be destroyed. The munition(s) to be destroyed are taken out of the stockpile and placed on the explosive charges of the principal flat blank. The device is then closed by a folding type machine. The closure of the package making up the packaging equipped with its explosive charges and enclosing the dangerous object to be destroyed is secured, for example, by adhesive tape.

Figure 3A:
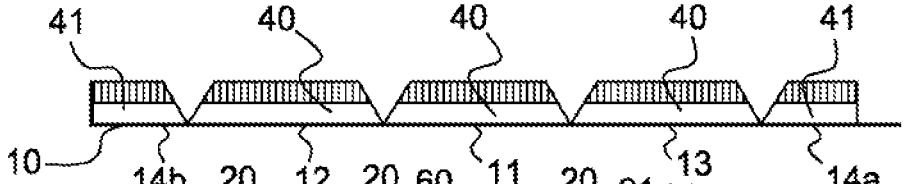
FIGS. 3A through 3F are end views of a sample aspect of a device according to the disclosed embodiment in several steps of its production.
Figure 3B:
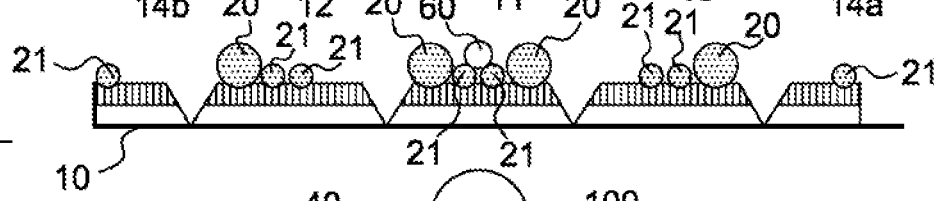
Figure 3C:
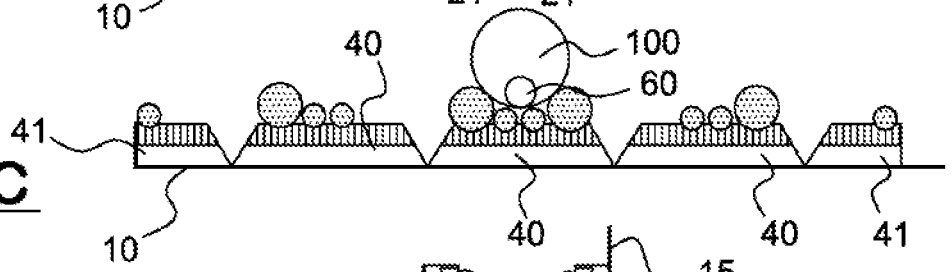
Figure 3D:
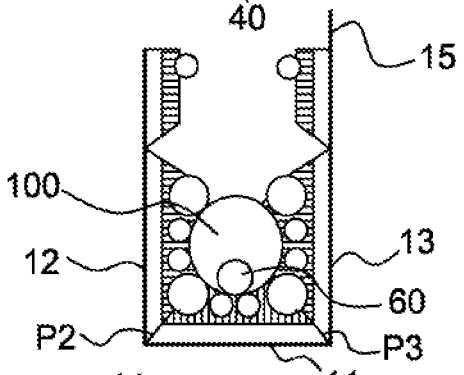
Figure 3E:
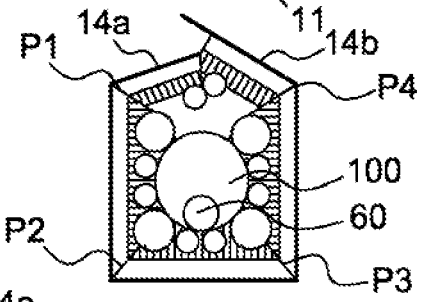
Figure 3F:
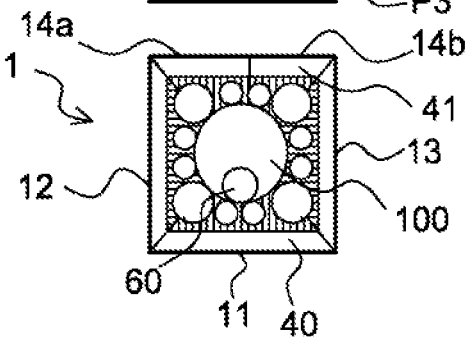

The steps of the method for implementing the device according to the disclosed embodiment are shown schematically in FIGS. 3A through 3F and involve:

- step A (as shown in FIG. 3A): placement of the flat blank for receiving the munitions, folded and provided with its support plates, which comprise here lateral cuts of 45° to enable the folding of the flat blank along its folding lines;
- step B (as shown in FIG. 3B): putting in place the explosive charges in an arrangement of thick charges 20 and thin charges 21 ensuring a good coverage of the charge to be destroyed once the package has been folded, then putting in place an ignition line;
- step C (as shown in FIG. 3C): placement of the munition (s) or charge(s) to be destroyed on the side around which the package will be folded up;
- steps D, E, F (as shown in FIGS. 3D, 3E, and 3F, respectively): progressive closing of the package along the folding lines p2, p3 to fold up the lateral sides 12, 13 around the principal side 11, then p1, p4 to fold up the upper half-sides 14*a*, 14*b;*

In the package folded up per step F, the foam plates firmly apply the explosive charges to the charge to be destroyed.

Figure 4:
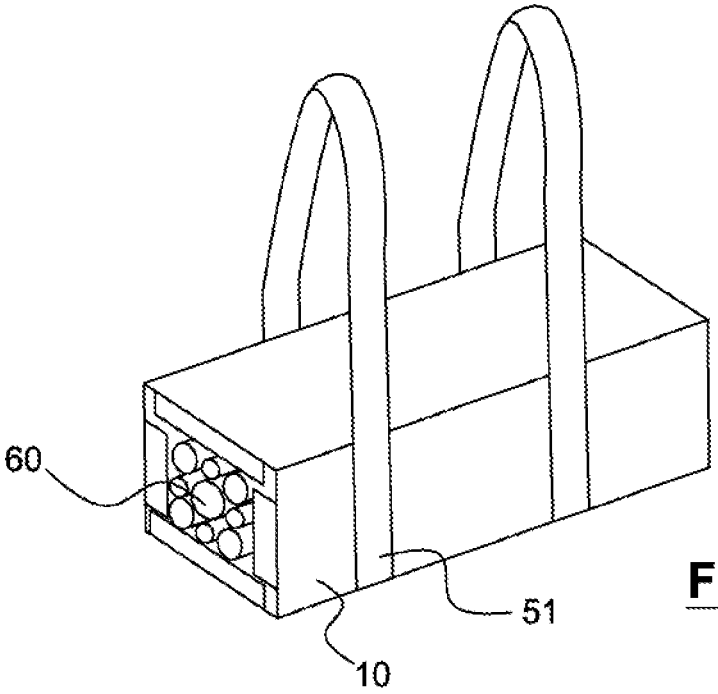
FIG. 4 is the device of FIG. 1 in perspective view with its holding straps.

The finished package is in the form of a tubular box, here, of square or rectangular cross section as represented in FIG. 4, with holding straps 51, for example secured in advance beneath the flat blank so that their releasing and putting in place is possible with a single movement.

Figure 5:
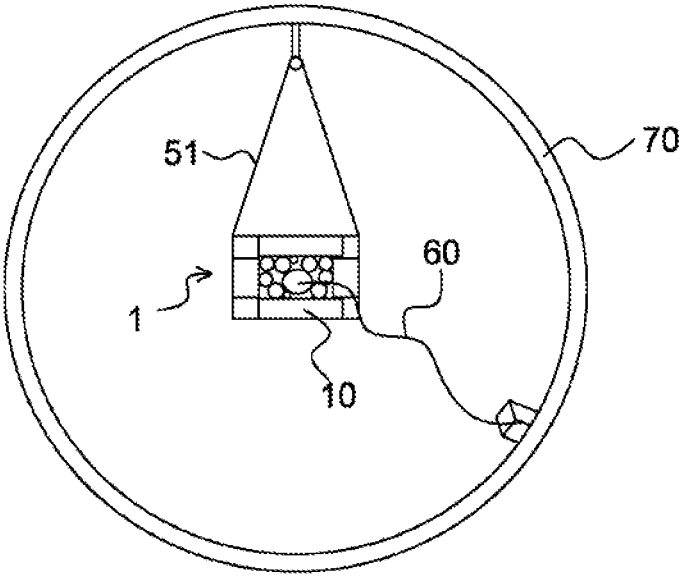
FIG. 5 is the device of FIG. 4 in an end view, attached in a detonation chamber by its holding straps.

The rest of the process involves the attachment of the box or package to a cargo handling apparatus by means of straps 51 and the placement of the box in a detonation chamber 70, as represented in FIG. 5 by the cargo handling apparatus, which can be a remote-guided robot.

The method of detonation of the box is then carried out.

All of the materials chosen meet two requirements: a minimal cost, considering that the box is for one-time use, and reduced gas volume emitted during the combustion of the box in the chamber. This latter requirement corresponds in general to the definition of a maximum allowable weight and a maximum content of organic material.

Figure 6A:
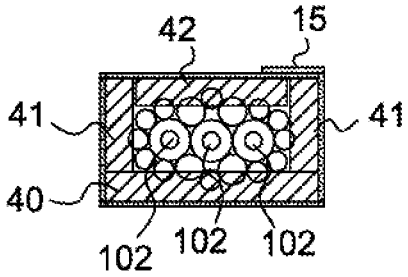
FIGS. 6A through 6G are end views of nonlimiting sample aspects of devices according to the disclosed embodiment.
Figure 6E:
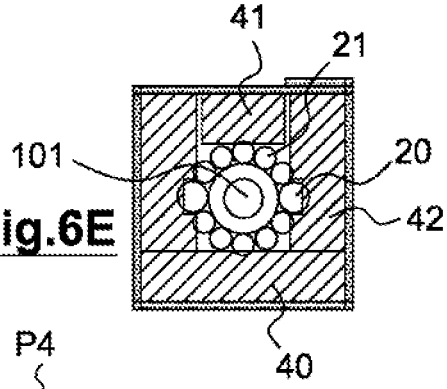
Figure 6B:
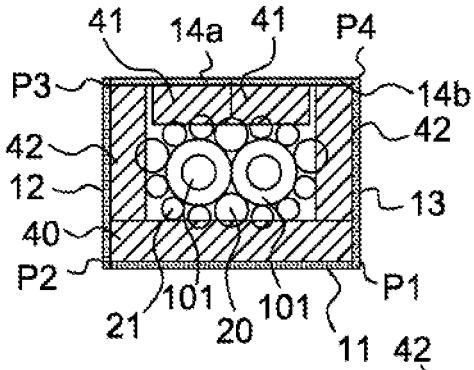
Figure 6D:
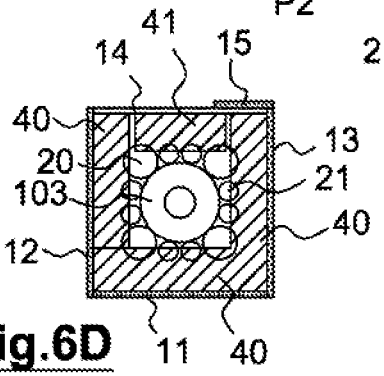
Figure 6C:
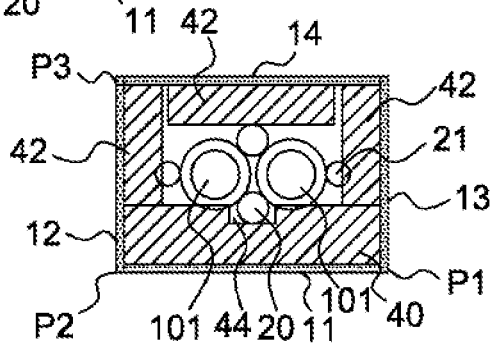
Figure 6F:
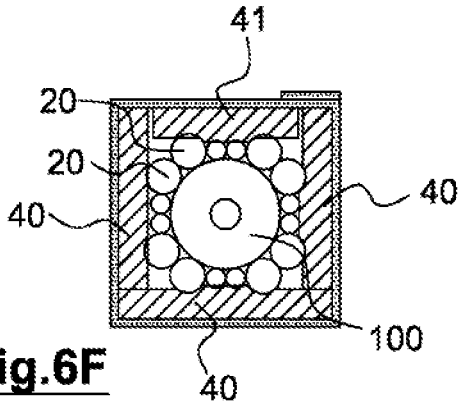
Figure 6G:
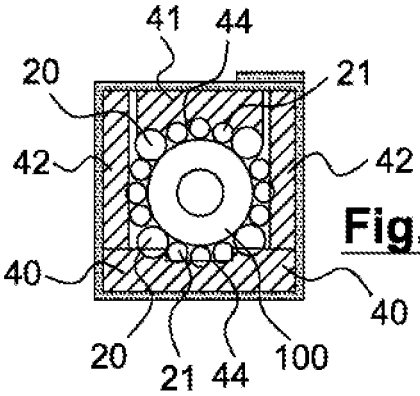

The cutout of the foam blocks is adapted to the shape and the weight of the munitions. The examples of FIGS. 6A to 6G give a nonlimiting survey of possible arrangements for:

- in the case of FIG. 6A, three small munitions 102, a box with four sides and flap 15, and foam blocks 40, 41, 42 of three different widths;
- FIGS. 6B and 6C, two possible arrangements for two medium munitions 101. The arrangement of FIG. 6B corresponds to a box formed along four folds p1, p2, p3, p4 with two half-sides 14*a*, 14*b* at the top surface, the arrangement of FIG. 6C corresponds to a box formed along three folds p1, p2, p3, with one side 14 at the top surface folded from a first lateral face 12 and meeting a second lateral face 13. This box furthermore comprises a lower foam plate provided with a cutout 44 able to hold an explosive charge 20 and thus bring together the charges to be destroyed;
- FIGS. 6D and 6E, two arrangements produced for large munitions 103, the arrangement of FIG. 6D placing thick charges 20 at the corners of the box while the arrangement of FIG. 6E places them on lateral faces sunken in cutouts of lateral plates;
- FIGS. 6F and 6G, arrangements also intended for large munitions 103, showing arrangements of thick 20 and thin 21 explosive charges able to handle various situations depending on the solidity of the charge to be destroyed.

The device of the disclosed embodiment can be modified in particular as regards the use of foam blocks of different density to prevent a crushing due to the weight of the munition, a definition of the dimensions of the box corresponding to different calibers, with boxes compatible with 2 or 3 munitions for small calibers, the use of straps folded along the box to allow their grabbing and deployment by a robot manipulator, the use of a system of connection of the ignition line 60, the possibility of simultaneously introducing several boxes in a detonation chamber by using a box support tray, such as a honeycomb acrylate plastic plate. In this case, an ignition line common to all the boxes and secured to the tray can be used.

Figures 7A, 7B:
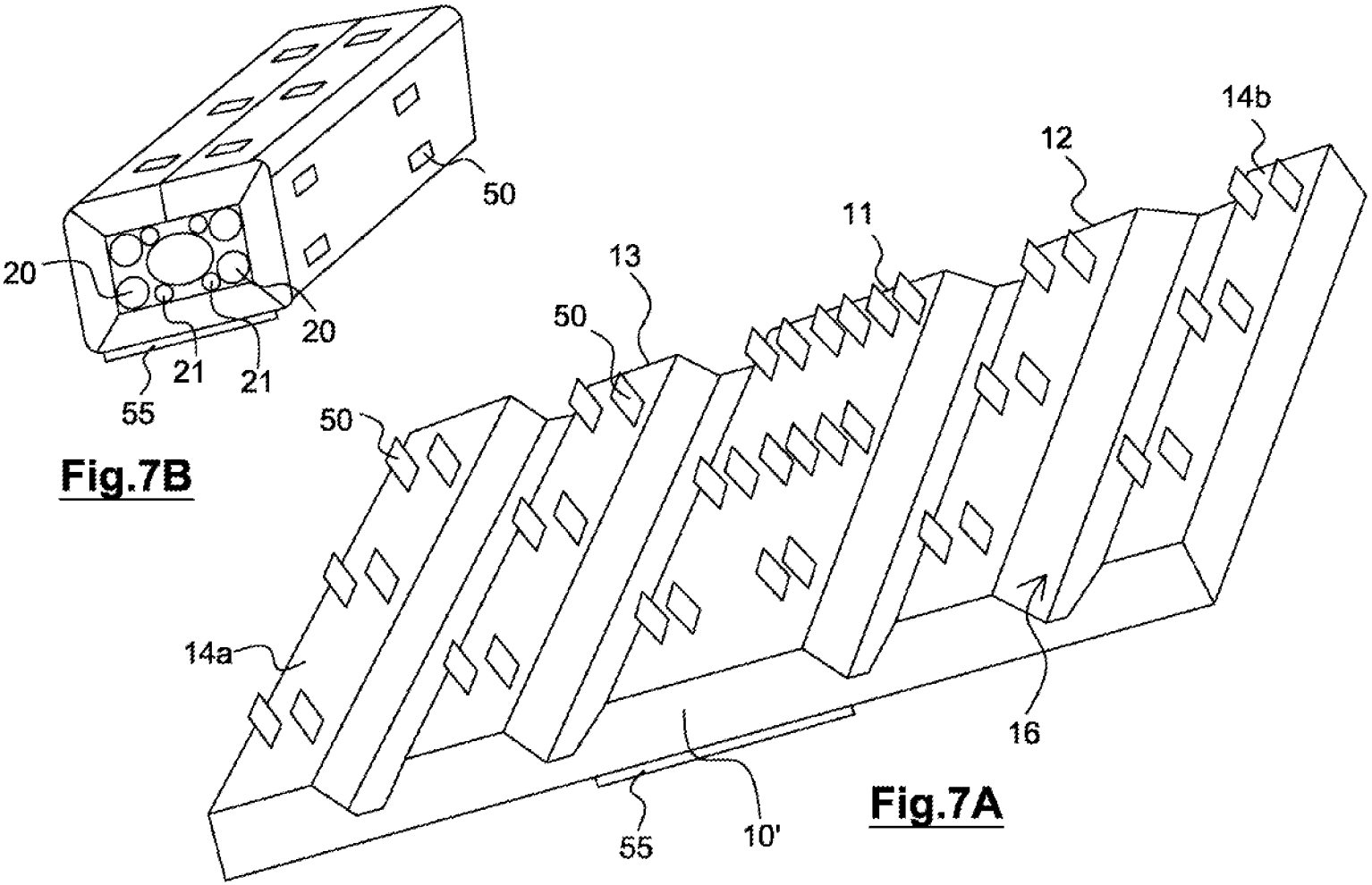
FIGS. 7A and 7B are perspective views of a second aspect of the disclosed embodiment, unfolded and folded.

The example of FIG. 7A is a variant for which the flat blank 10' is directly realized in foam and provided with cutouts between the sides in the form of V-shaped grooves 16 adapted to produce zones of reduced thickness allowing the flat blank to be folded along four sides in order to produce the tubular package of FIG. 7B.

In this example, the means 50 of fixation of the charges are comprised of straps inserted into slits of the foam and closing around the explosive charges.

The example of FIGS. 7A and 7B comprises a support plate 55 which can also be used in the case of the example of FIG. 1 and which can comprise in particular means of securing the holding straps.

Figure 8:
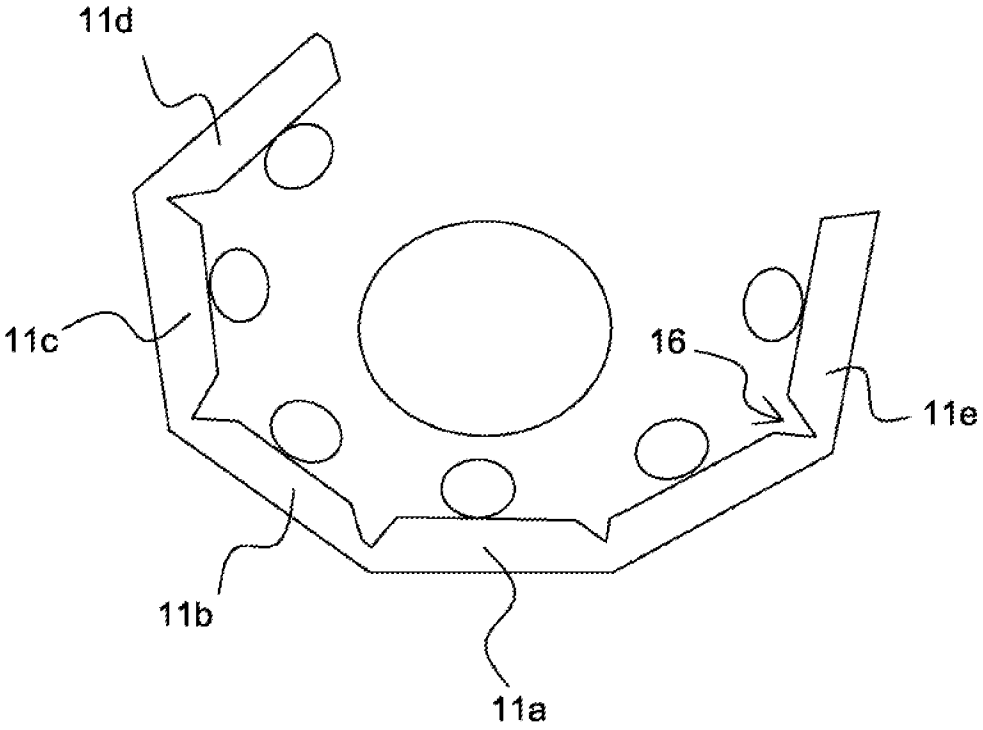
FIG. 8 is a perspective view of a packaging of polygonal cross section.

FIG. 8 shows a packaging of polygonal cross section, here hexagonal, having sides 11*a* to 11*e* of identical dimension. In this example, the sides are produced directly in the flat blank of foam provided with V-shaped grooves 16 for folding, like the flat blank of FIG. 7A. Such a flat blank is made of a sufficiently dense foam to do without a flat cardboard blank on which the foam plates are arranged.

The hexagonal geometry makes it possible to distribute the charges more uniformly about the object to be destroyed and it is conceivable in the context of the disclosed embodiment to further increase the number of sides.

Besides the destruction of weapons of explosive content, the disclosed embodiment can be used for the preparation for the destruction by detonation of any dangerous objects whose dismantling by other means would prove to be risky or too costly. In fact, the disclosed embodiment is able to be easily adapted to objects of different and various shapes and dimensions in the context of the destruction by detonation of dangerous products which is adapted to the destruction of a large number of toxic molecules.

What is claimed is:

1. A device that is configured to destroy objects by detonating said objects, the device comprising:

- a packaging produced from a flat blank that is configured to be folded on itself along at least three fold lines to form one of (a) at least three sides and two half-sides, (b) four sides or (c) four sides and a flap that is configured to close the packaging, the packaging, in a folded state, having a tubular shape with a polygonal cross-section that is configured to receive explosive charges, which are placed on one of the at least three sides and the two half-side or the four sides that are folded, said flat blank having dimensions suited to house, in a middle of the packaging in contact with the explosive charges, at least one of said objects that are to be destroyed.

2. The device that is configured to destroy objects as claimed in claim 1, further comprising support plates that are secured to one of the at least three sides and the two half-side or the four sides and are arranged between the explosive charges and said one of the at least three sides or the four sides in the folded state, the support plates having a width such that portions of the at least three sides and the two half-side or the four sides are foldable.

3. The device that is configured to destroy objects as claimed in claim 2, wherein the support plates are comprised of flexible polymer foam.

4. The device that is configured to destroy objects as claimed in claim 3, wherein the support plates have a thickness that is adaptable to a diameter of the explosive charges and a diameter of the object to be destroyed so as to maintain contact with the explosive charges and the objects to be destroyed.

5. The device that is configured to destroy objects as claimed in claim 1, wherein the flat blank is a flat foam blank that is made of a polymer foam having pre-cut folds.

6. The device that is configured to destroy objects as claimed in claim 1, wherein the flat blank is comprised of a flat cardboard blank having folding lines.

7. The device that is configured to destroy objects as claimed in claim 3, wherein the polymer foam is a polyurethane foam.

8. The device that is configured to destroy objects as claimed in claim 1, further comprising means of fixing the explosive charges to at least the at least three sides of the packaging.

9. The device that is configured to destroy objects as claimed in claim 1, further comprising holding straps that are fixable to the packaging.

10. The device that is configured to destroy objects as claimed in claim in 1, further comprising an ignition line that is configured to ignite the explosive charges.

11. A method of producing a package for destroying objects by detonating said objects, the method comprising:

laying flat a flat blank that is configured to be folded on itself along at least three fold lines to form one of (a) at least three sides and two half-sides, (b) four sides or (c) four sides and a flap such that the packaging, in a folded state, has a tubular shape with a polygonal cross-section;

placing at least one explosive charge on one of the at least the at least three and two half sides or the four sides;

placing an object which is to be destroyed on one of one of the at least three sides, one of the two half sides or one of the four sides;

placing an ignition line in contact with at least one of the at least one explosive charge; and folding the flat blank so that the object to be destroyed is surrounded by the at least one explosive charge.

12. The method of producing a package for destroying objects as claimed in claim 11, further comprising the step of positioning flexible foam plates on the at least three sides and two half side or the four sides of the flat blank prior to placement of the explosive charges and then placing the explosive charges on the plates.

13. The method of producing a package for destroying objects as claimed in claim 11, wherein the flat blank is made of foam and includes pre-cut folds and slits to receive stowage straps.

14. The method of producing a package for destroying objects as claimed in claim 13, further comprising the step of securing the explosive charges to the at least three sides and two half side or the four sides by the stowage straps.

15. The method of producing a package for destroying objects as claimed in claim 11, further comprising the steps of providing holding straps that are attached to the package, attaching the package to a cargo handling apparatus by the holding straps, placing the package by the holding straps in a detonation chamber, and then detonating the package by the ignition line.

16. The device for destroying objects as claimed in claim 1, wherein the packaging, in a folded state, has a tubular shape with one of a square and rectangular cross-section.

* * * * *